United States Patent [19]

Houke et al.

[11] 4,023,983

[45] May 17, 1977

[54] VAPOR CLEANING SYSTEM

[75] Inventors: Howard F. Houke, Concord; Freeman C. Anderson, Pleasant Hill, both of Calif.

[73] Assignee: Collins Machinery Corporation, Concord, Calif.

[22] Filed: Oct. 28, 1975

[21] Appl. No.: 626,091

[52] U.S. Cl. ..... 134/11; 134/21; 134/31

[51] Int. Cl.[2] ..... B08B 5/00

[58] Field of Search ..... 134/2, 11, 21, 31, 37, 134/40; 8/149.2; 68/5 C, 6; 169/45; 202/170

[56] References Cited

UNITED STATES PATENTS

| | | | |
|---|---|---|---|
| 3,106,928 | 10/1963 | Rand | 134/11 X |
| 3,460,990 | 8/1969 | Barday | 134/11 X |
| 3,663,293 | 5/1972 | Surprenant et al. | 134/11 |
| 3,699,982 | 10/1972 | Pipkins | 134/31 X |
| 3,772,082 | 11/1973 | Dunn | 134/11 X |
| 3,904,102 | 9/1975 | Chu et al. | 134/31 X |

*Primary Examiner*—S. Leon Bashore
*Assistant Examiner*—Marc L. Caroff
*Attorney, Agent, or Firm*—Michael D. Nelson

[57] ABSTRACT

A solid substance is cleaned by a vapor cleaning method. In the method, a cleaning vessel which is opened to the atmosphere at its top is used. A hazardous solvent is vaporized at the bottom of the vessel and cooling coils within the vessel condense the vapors as they travel upwardly to the open top. The solid substance to be cleaned is placed in a zone where the vapors are condensing. The invention resides in blanketing the top of the condensing vapors with an inert gas which is less hazardous than the volatile solvent thereby forming a buffer layer between the atmosphere and the solvent. The gas has a density at the conditions existent within the buffer layer which is greater than the density of air at ambient conditions, and has a boiling point below the boiling point of the solvent.

7 Claims, 1 Drawing Figure

VAPOR CLEANING SYSTEM

BACKGROUND OF THE INVENTION

Each year numerous people are injured by the use of hazardous cleaning solvents. These injuries typically occur because the cleaning solvent employed forms explosive compositions when its vapors are mixed with air and are accidently detonated, or because the volatile cleaning solvent is toxic and workers exposed to the toxic vapors receive an unhealthy dose.

Elimination of these toxic and/or combustible solvents is not an acceptable alternative since many the solvents cannot be adequately substituted. Likewise, the restricted use of these solvents in protective chambers or hoods is not acceptable because of the prohibitive cost of such chambers or hoods and because of the limited mobility associated with their employment.

The hazards involved in using cleaning solvents are accentuated in vapor cleaning processes. In a typical vapor cleaning process, vapors of the cleaning solvent are passed over the part or mechanical device sought to be cleaned. At this point, at least a portion of the vapors are condensed on the part or device to constantly bathe it in fresh cleaning solvent. The condensed solvent drips from the object carrying with it the contaminates. The point at which the vapors contact the atmosphere poses the threat. For example, if the vapors are combustible they form explosive composition at this vapor-air interface. Also some of the vapors which are not condensed may escape the surrounding area, depending upon its toxicity, could pose a health threat to workers in the area.

Vapor cleaning is particularly useful in cleaning glass and plastic lenses where spot free surfaces are essential. Water when it evaporates from the lens surface forms spots which adversely interfer with the true optical performance. These spots are caused by water-soluble salts contained in the water. Even trace amounts of these salts result in undesired water spots. However, the use of distilled water is not satisfactory since water tends to leach small amounts of salts from glass and other types of materials. The use of cleaning solvents such as acetone can achieve a highly spot free surface. Acetone, on the other hand, can form an explosive mixture with air and accordingly is hazardous to use.

A need therefore exists for reducing the hazards associated with the use of heretofore hazardous solvents, which does not limit the mobility and usefulness of the cleaning apparatus, which can be readily used, which is inexpensive to manufacture and operate, and which can be used in vapor cleaning systems.

It is an object of this invention to provide an improved method for vapor cleaning a solid substance.

It is an additional object of this invention to provide an improved vapor cleaning apparatus.

It is an additional object of the invention to provide a method and apparatus for safely vapor cleaning a solid substance with a hazardous volatile solvent.

Other additional objects of this invention will become apparent from the attached drawing, the following description of the invention and the accompanying claims.

SUMMARY OF THE INVENTION

The aforementioned objects and their attendant advantages can be realized by an improved vapor cleaning apparatus and method of this invention. The apparatus comprises a cleaning vessel, open to the atmosphere at its top having an upper cleaning zone and a lower condensate receiving zone. Heat is removed from the cleaning zone by cooling coils located within the zone. A containing means is positioned immediately below the condensate receiving zone for collecting and receiving condensate of the cleaning solvent. A heater is positioned within the condensed receiving zone for supplying heat to vaporize at least a portion of the cleaning solvent. Means for supplying a gas to a gaseous buffer zone is positioned above the cleaning zone.

In operation, the solid substance to be cleaned is placed in the cleaning zone. A hazardous volatile cleaning solvent is charged to the cleaning apparatus and the heating and cooling means are turned on. The heater vaporizes a portion of the cleaning solvent and the vapors travel upwardly into the cleaning zone. The vapors are condensed in this zone by the cooling coils. Any solid substance positioned in this zone is contacted with the cleaning solvent while the solvent is present in both the vapor and liquid state. The liquid cleaning solvent bathe the solid substance extracting out the contaminants. The solvent condensate drips from the solid substance downwardly to be collected in the condensate receiving zone carrying the contaminates with it. The improvement of this invention resides in the injection of a gas immediately above the cleaning zone so as to provide a gaseous buffer layer between the vapors of the cleaning solvent in the cleaning zone and the air in the atmosphere. Gases which may be employed to form the gaseous buffer layer must be less hazardous than the cleaning solvent, it should be relatively inert to the cleaning solvent, it should have a density at the conditions existent within the buffer layer which is greater than the density of air at ambient conditions surrounding the cleaning vessel and it should preferably have a boiling point below the boiling point of its cleaning solvent.

By providing a gaseous buffer layer between the vapors of the hazardous cleaning solvent and the air in the atmosphere, explosive mixtures can be avoided, even though a highly combustible solvent is employed. In addition, exposure of workers to toxic solvent vapors can be substantially reduced. The gaseous layer is convenient since it does not interfer with easy loading or unloading of parts or devices from the cleaning apparatus. Although the exact mechanism of the gaseous buffer layer in reducing the amount of vapor which penetrates the layer and escapes to the atmosphere is not known, it is believed that the cooling coils reduce the temperature of the cleaning zone sufficiently to cool all of the vapors and the gaseous buffer layer functions as an extension of the cooling zone. This extension provides added assurance that any wandering vapors will be condensed before penetration of the buffer layer occurs. This buffer layer thus prevents a potentially dangerous mixing of air and vapors.

DETAILED DESCRIPTION OF THE INVENTION

Figure 1:
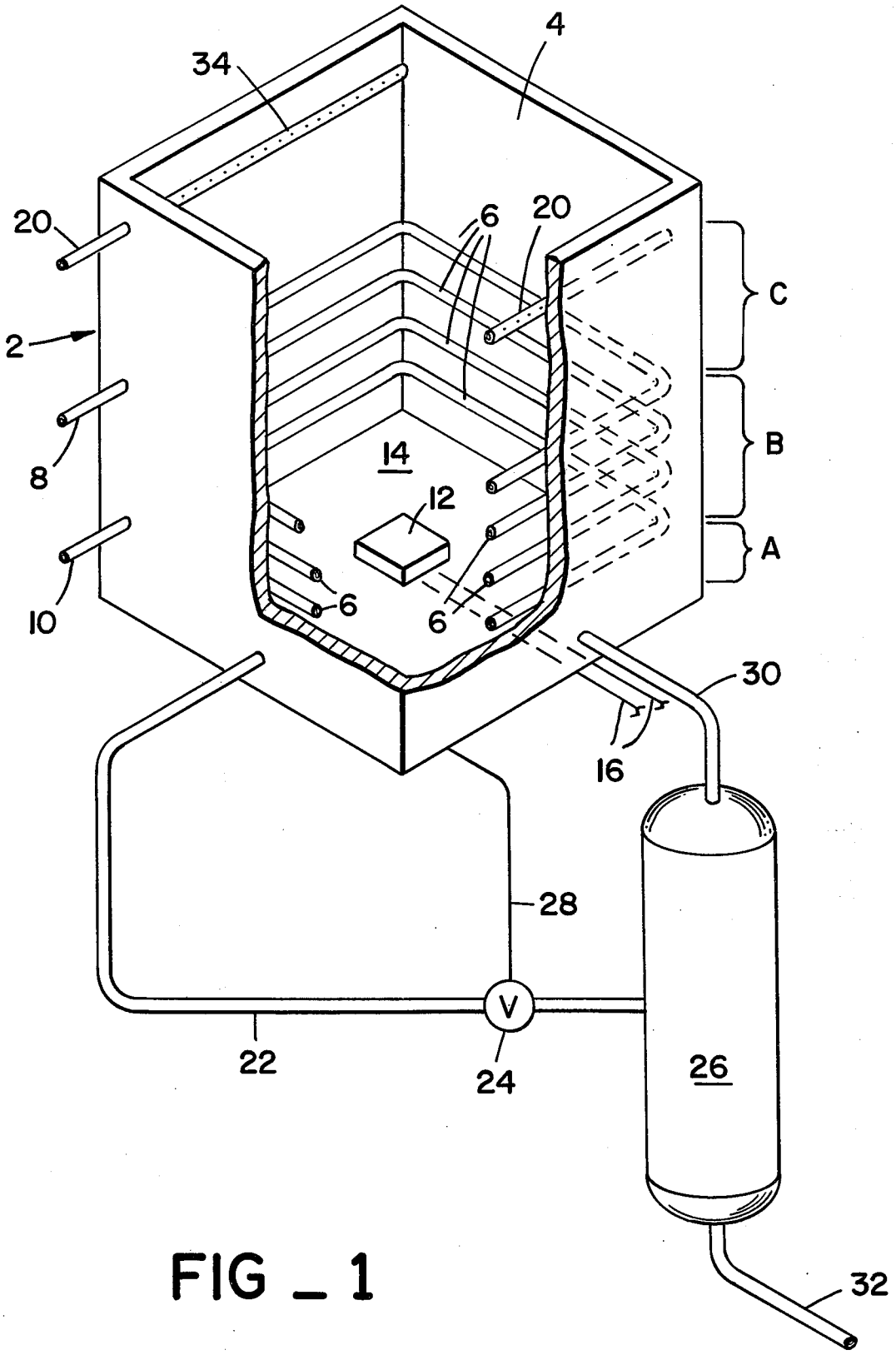

When references are made to the accompanying drawing, the similar characters of reference represent the same corresponding parts. The accompanying drawing is a perspective view of a cleaning apparatus constructed in accordance with the present invention with a section removed to display the underlying structure and parts.

While only a preferred embodiment of the invention is illustrated by the drawing it should be understood that various changes or modifications may be made within the intended scope of the claims attached hereto without departing from the spirit of the invention.

Referring now to the drawing, cleaning apparatus 2 is illustrated with its top 4 open to the atmosphere. The apparatus is arbitrarily divided into three zones. The lowest zone A is for the collection of the solvent condensate. The next zone B is the cleaning zone, and the top zone C is the gaseous buffer layer. Cooling coils 6 are positioned within the cleaning zone B for removing heat, either continuously or intermittently, from this zone. An inlet 8 and outlet 10 is provided for circulating a coolant through the cooling coils. An electric heater 12 is positioned at the bottom 14, of the condensate receiving zone A and is controlled by wires 16. Bottom 14 encloses the bottom of cleaning apparatus 2 so that the cleaning solvent may be contained within the apparatus.

At the top of the cleaning apparatus, two gas spargers 20 are provided to uniformly inject gas along the top of the apparatus at zone C. This gas forms the gaseous buffer layer between the vapors of cleaning solvent and the atmosphere.

As the cleaning solvent is condensed in the cleaning zone, the condensate drops downwardly and is collected in zone A. The condensate solvent carries with it the contaminates from the solid substance. In order to avoid accumulation of contaminants within the cleaning solvent, a bleed stream is withdrawn from zone A through pipe 22 and control valve 24 to purifier 26. An activating signal is connected to zone A through wire 28, and when the contaminants level reaches a designated level, a signal carried through wires 28 opens valve 24. A set amount of cleaning solvent plus contaminants is charged into purifier 26. Purifier 26, which in many embodiments comprises a simple distillation system, separates the cleaning solvent from the contaminants. The purified cleaning solvent in the form of vapors or liquid solvent is returned to the cleaning apparatus through return pipe 30 while the contaminants are discharged through pipe 32.

The drawing displays a rectangular vessel closed at its bottom with a flat plate. The cleaning vessel can be of any convenient cross-sectional shape, such as cylindrical, conical, oval, cubical, etc., similarly the bottom can be of any convenient cross-section as long as it is capable to containing the cleaning solvents. The particular shape can be designed for each application. The top of the vessel must be open to the atmosphere, however, it should be recognized that the entire surface need not be open. The vessel may be insulated to prevent the loss of heat for zone A to the surrounding environment or to prevent heat from going into zone B from outside the vessel. The cleaning vessel may itself float in a liquid medium such as an ultrasonic bath, etc.

The cooling means can comprise, in the most convenient embodiment, cooling coils mounted within the vessel and preferably along the inner surface. The coils are preferably spaced a sufficient distance from the bottom of the vessel to provide a cleaning zone to adequately encompass the solid substance to be cleaned. Preferably the cooling means begins above the midpoint of the vessel and extends to a point below its midpoint; however, the cooling means could extend to the top of the vessel thereby providing a means for cooling the gaseous buffer layer. A coolant having a freezing point below the boiling point of the cleaning solvent is employed. Typical coolants include Freons, ammonia, water, etc. It is also preferred to introduce the coolant into the top of the cooling coils and withdraw it at the bottom. In this particular embodiment the coldest portion of the coolant can be maintained at the top of the cooling zone thereby increasing the probability of condensing all of the solvent vapors. It should be recognized that the cooling coils could be mounted on the exterior of the vessel 2 or alternatively, the entire vessel could be cooled by placing it in a coolant bath.

The heater 12 is placed within the cleaning vessel and should be submerged within the volatile cleaning solvent. The heater can be an electrical heater or alternatively a series of heating coils. In another embodiment, the heater is external from the vessel and the heat is supplied by the cleaning solvent. Thus in this embodiment the cleaning solvent is vaporized outside the vessel and the vapors injected therein.

The gas to the gaseous buffer layer is supplied by a gas sparger 20 positioned above the cleaning zone. The sparger can comprise a gas plenum surrounding the inner surface of the vessel with holes 34 spaced uniformly along its perimeter. It should be recognized that a wide variety of means for introducing the gas into the upper zone C can be used without departing from the inventive concepts herein disclosed. For example, a single tube can be used, or a baffle arrangement can be utilized.

The gaseous buffer layer preferably has a thickness varying from 0.05 to 5 times the thickness of the cleaning zone and more preferably from 0.1 to 2 times the thickness of the cleaning zone.

In operating the apparatus of this invention, a volatile cleaning solvent is charged to the cleaning vessel. The heater is turned on and operated at a temperature sufficient to vaporize a substantial portion of the solvent. A coolant is circulated through the cooling soils and maintained at a temperature sufficient to reduce the temperature within the cooling zone below the boiling point of the cleaning solvent, thus condensing the vapors. An inert gas is injected into the top of the cleaning vessel so as to provide a continuous gaseous buffer layer between the cleaning solvent vapors and the air in the atmosphere. A small amount of the gas is continually added to the buffer layer to replace any gas lost to the atmosphere.

The part or device to be cleaned is lowered through the gaseous buffer layer and positioned within its cleaning zone. In this zone, the part or device is contacted with the cleaning solvent which is concurrently in the liquid and vapor state. The vapors of solvent are continuously condensing on the part or device and dripping off carrying with it a small amount of contaminants. The condensate falls downwardly and is collected within the condensate receiving zone. The condensed solvent is then vaporized leaving the contaminants to slowly accumulate in the liquid solvent.

After the part or device has been cleaned it is raised through the gaseous buffer layer to the atmosphere. By slowly raising the part or device through the buffer zone any remaining solvent can be stripped and returned to the cleaning zone.

The contaminants within the liquid cleaning solvent can be removed periodically or continuously by withdrawing a small portion or bleed stream of the liquid solvent mixture. The solvent-contaminants mixture is sent to a purifier where the solvent is recovered and returned to the cleaning apparatus and the contaminants are discharged. In embodiments where the contaminants increase the boiling point of the cleaning solvent, a thermal detector can be used to determine when a bleed stream should be removed for purification. The thermal detector could automatically open and close a control valve 24.

The purifier can be a distillation column, a phase separator or a solvent extraction system depending upon the type of solvent used and the type of contaminant encountered.

The type of cleaning solvent which can be used in the method of this invention can comprise any volatile cleaning solvent which is classified as hazardous. As used herein hazardous shall mean any solvent the vapors of which can form an explosive mixture when combined with air or any solvent or solvent vapors which have a threshold limit as defined by the O.S.H.A. which is less than 1000 parts per million (ppm) and preferably which is less than 500 ppm. The following table displays some exemplary cleaning solvents and the threshold limit valves:

TABLE I

| CLEANING SOLVENTS | |
|---|---|
| SOLVENT | THRESHOLD LIMIT (ppm) |
| Acetaldehyde | 200 |
| Acetic Acid | 10 |
| Acetone | 1000 |
| Ammonia | 50 |
| Benzene | 25 |
| Butanone -2 | 200 |
| Butyl Acetate | 150 |
| Butyl Alcohol | 100 |
| Butylamine | 5 |
| Butyl glycidyl ether | 50 |
| Carbon disulfide | 20 |
| Carbon Tetrachloride | 10 |
| Chlorobenzene | 75 |
| Chlorobromo Methane | 200 |
| Chloroform | 50 |
| Cyclohexane | 300 |
| Dioxane | 100 |
| Ethoxyethanol | 200 |
| Ethyl Alcohol | 1000 |
| Ethylene Oxide | 50 |
| Formaldehyde | 5 |
| Furfural | 5 |
| Hexane | 500 |
| Hydrogen Chloride | 5 |
| Hydrogen Sulfide | 10 |
| Isopropyl Alcohol | 400 |
| Isopropyl Acetate | 250 |
| Methylene Chloride | 500 |
| Methyl Isobutyl Carbinol | 25 |
| Ethylene Glycol | — |
| Kerosene | — |
| Nitric Acid | 2 |
| Pentane | 500 |
| Propylene Oxide | 100 |
| Pyridine | 5 |
| Sulfur dioxide | 5 |
| Tetrahydrofuran | 200 |
| Toluene | 200 |
| Phenol | 5 |

Some general classes of exemplary solvents which may be used includes organic solvents such as $C_1$ and $C_6$ aldehydes, $C_1$ to $C_{10}$ ketones, $C_1$ to $C_{10}$ alcohols, $C_1$ to $C_{10}$ haloalkanes, $C_4$ to $C_{18}$ hydrocarbons, $C_1$ to $C_{10}$ ethers, $C_1$ to $C_{10}$ carboxylic acids, $C_1$ to $C_{10}$ hydrocarbylamines, etc., as well as the inorganic solvents. This general list should not be interpreted as inclusive of only those classes recited. The particular type of solvent or mixture of solvents selected will vary depending upon the type of contaminant to be removed, the type of part or device sought to be cleaned, the selected operating conditions, etc. If water is the contaminant then solvents such as acetone, ammonia, ethanol, methyl ethyl ketone, etc. may be used. If greases constitute the contaminant then hydrocarbon solvents such as hexane, pentane, octane, etc., may be used. It is within the skill of those in the process industries to select the proper solvent for the particular cleaning process.

The gas which may be employed to form the gaseous buffer layer must be less hazardous than the cleaning solvent, otherwise, the safety aspects associated with this invention are lost. The gas should have a density at conditions existent within the buffer layer which is greater than the density of the air surrounding the cleaning apparatus. The density of the gas may be equal to or lighter than air when measured at the same conditions, since the buffer layer may be substantially cooler than the air surrounding the vessel. The gas should be relatively inert or unreactive with the vapors of the cleaning solvent, otherwise a reaction may occur at the vapor-gas interface. Finally, the gas should preferably have a boiling point which is lower than the boiling point of the solvent. If the gas had a boiling point equal to or greater than the solvent, then a portion of the gas will condense within the cleaning vessel. This will necessitate the introduction of additional amounts of gas into the buffer zone and require purifying the liquid solvent/gas condensate/contaminant solution in order to avoid accumulation of the gas condensate.

Exemplary gases which may be employed include carbon dioxide, nitrogen, the heavy noble gases, such as, argon krypton, xenon, etc., certain Freons, organic vapors, etc.

The method and apparatus of this invention has particular utility in the cleaning of optical lenses. The lens is placed in the cleaning zone and an exemplary cleaning solvent preferably acetone is employed. Carbon dioxide is used to provide the gaseous buffer layer. After a short period the lens is removed from the cleaning zone spotlessly clean.

The method and apparatus of this invention can be used to clean mechanical parts or devices whether made of plastic, metals, glass, etc. It may be used to clean lenses, mirrors, printed circuit boards, crystals, photographic slides, dehydrating food stuffs, etc. In a particularly useful application, the invention may be used in cleaning microelectronic circuits. It may be used to wash radio-active contaminants from solid surfaces, etc.

In a particularly preferred embodiment, the gas to the gaseous buffer layer has a density less than the density of the vapors of cleaning solvent at the conditions existent within the cleaning vessel at the vapor-gas interface.

It is also recognized that a lid may cover the opening of the cleaning vessel to the atmosphere during the cleaning process and removed when the solid substance to be cleaned is withdrawn or inserted.

We claim:

1. In a method for cleaning a solid substance within a cleaning vessel open to the atmosphere at its top wherein vapors of a conbustible cleaning solvent are passed through a cleaning zone in said vessel containing said solid substance and are condensed within said zone, so that said solid substance is contacted with said cleaning solvent which is in both the liquid and vapor state, the improvement in avoiding explosive mixtures of said vapors with air which comprises maintaining a buffer layer of a non-combustible gas immediately above said cleaning zone between the vapors of said cleaning solvent and the air in the atmosphere; said gas (1) being unreactive with the vapors of said cleaning solvent, (2) having a density at conditions existent within said buffer layer which is greater than the density of air at ambient conditions and (3) having a boiling point below the boiling point of said cleaning solvent.

2. The method defined in claim 1 wherein condensate of said cleaning solvent is collected at the bottom of said cleaning vessel and at least a portion thereof vaporized and the vapors returned to said cleaning zone.

3. The method defined in claim 2 wherein said solvent is selected from $C_1$ to $C_6$ aldehydes, $C_1$ to $C_{10}$ ketones, $C_1$ to $C_{10}$ alcohols, $C_1$ to $C_{10}$ haloalkanes, $C_4$ to $C_{18}$ hydrocarbons, $C_1$ to $C_{10}$ ethers, $C_1$ to $C_{10}$ carboxylic acids, and $C_1$ to $C_{10}$ hydrocarbylamines.

4. The method defined in claim 3 wherein said gas is selected from carbon dioxide or nitrogen or mixtures thereof.

5. The method defined in claim 2 wherein a portion of said condensate containing a contaminant removed from said solid substance is withdrawn from the cleaning vessel and purified to recover a substantial portion of said cleaning solvent free of said contaminant and wherein said purified solvent is recycled to said cleaning vessel.

6. The method defined in claim 5 wherein said cleaning solvent is acetone and wherein said gas is carbon dioxide.

7. In a method for cleaning lenses or microelectronic circuits within a cleaning vessel opened to the atmosphere at its top wherein acetone vapors are passed through a cleaning zone within said vessel containing said lenses or microelectronic circuits and are condensed in said zone, the improvement in reducing the amount of acetone that contacts the atmosphere which comprises maintaining a buffer layer of carbon dioxide immediately above said cleaning zone between the acetone vapors and the air in the atmosphere.

* * * * *